United States Patent [19]

Pokhis

[11] 4,398,365

[45] Aug. 16, 1983

[54] FIREARM

[76] Inventor: Naum Pokhis, 30-36 Magaw Pl., Apt. 5D, New York, N.Y. 10033

[21] Appl. No.: 59,748

[22] Filed: Jul. 23, 1979

[51] Int. Cl.[3] ..... F41C 9/00

[52] U.S. Cl. ..... 42/1 K

[58] Field of Search ..... 42/1 K

[56] References Cited

U.S. PATENT DOCUMENTS

| | | | |
|---|---|---|---|
| 1,314,951 | 9/1919 | Drews | 42/1 K |
| 1,863,563 | 6/1932 | Carlstrom | 42/1 K |
| 1,906,870 | 5/1933 | Palla | 42/1 K |
| 3,793,759 | 2/1974 | Deckard | 42/1 K |

*Primary Examiner*—Charles T. Jordan

*Attorney, Agent, or Firm*—Ilya Zborovsky

[57] ABSTRACT

A firearm has a barrel, elements for displacing carriages, bullets and the like to a next firing position, striking elements for striking the same, actuating elements for actuating said displacing and striking elements and including a bush with a trigger and at least two sights and movable between a first position in which it is located in the region of a forearm of the user so as to be concealed under a sleeve of the latter, and a second position in which it is displaced to a hand of the user so that the user can act upon the trigger and use the sights, whereby for firing only the bush with the trigger and the sights are displaced.

3 Claims, 8 Drawing Figures

FIREARM

BACKGROUND OF THE INVENTION

The present invention relates to a firearm for personal use. Known constructions of firearms have the following disadvantages:

In marching conditions such firearm is carried in a holster which is hung outside or under the clothes, in various pockets and under the belt. Such well-known locations give a possibility to a criminal to disarm a policeman, guard and the like.

Many cases are known when the firearm is lost and is easily gotten by a criminal or the criminal kills the policeman, guard and the like by this firearm.

The known firearm for personal use has a small charge.

The known firearm for personal use is in many cases short-barreled and because of this its firing range is small with identical other conditions.

The known firearm for personal use requires relatively much time for converting it from marching to firing order.

SUMMARY OF THE INVENTION

Accordingly, it is an object of the present invention to provide a firearm which avoids the disadvantages of the prior art. More particularly, it is an object of the present invention to provide such a firearm in which all parts of the proposed arm are designed and arranged in such a manner that it can be put on the forearm into the sleeve of the clothes and fixed near the hand by a small belt, because of this. Such a firearm, for example, a pistol is concealed in a location which has not been known up to now.

This location excludes the possibility of losing of the firearm and it is difficult to take away.

The pistol is multi-charged, because 25–30 and more charges (in accordance with the selected calibre) may be arranged at the circumference of the ring.

The barrel of the proposed arm is considerably longer than the barrel of the closest prototype (Nagant revolver) with the following advantages.

Because of the location of mounting, the arm may be converted into the firing position instantly.

The novel features which are considered as characteristic for the present invention are set forth in particular in the appended claims. The invention itself, however, will be best understood from the description of a preferred embodiment taken with accompanying drawing.

DESCRIPTION OF PREFERRED EMBODIMENT

Figure 1:
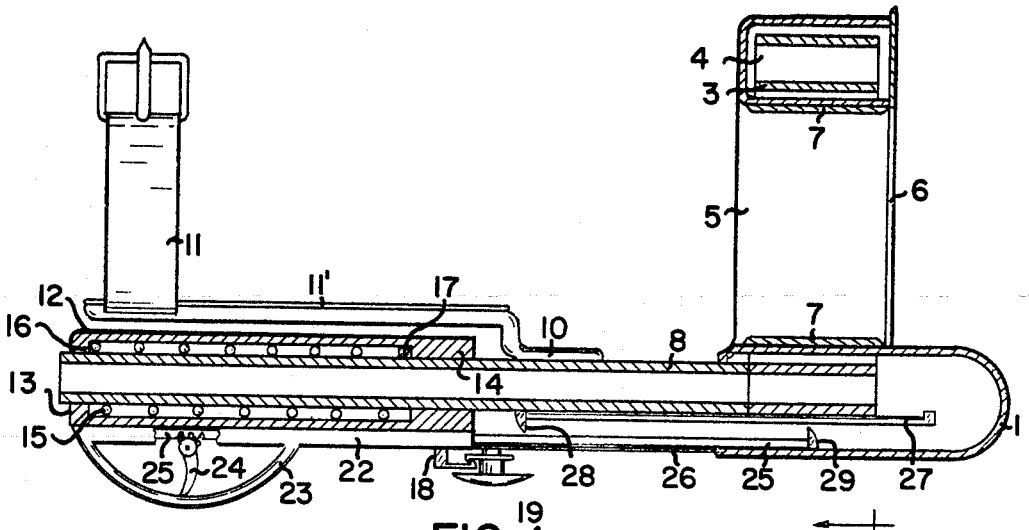
FIG. 1 is a section along the arrow I—I of FIG. 2 of the inventive firearm.
Figure 2:
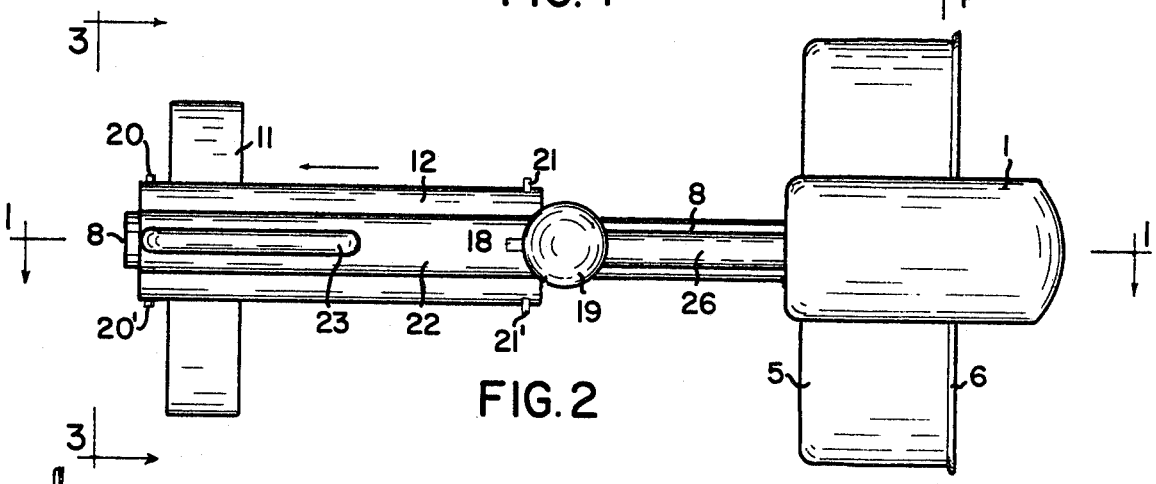
FIG. 2 is a general view of the firearm.
Figure 3:
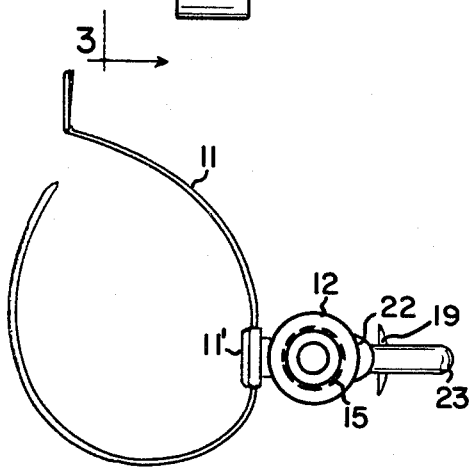
FIG. 3 is a view in the direction of the arrow 3—3 (see FIG. 2)
Figure 4:
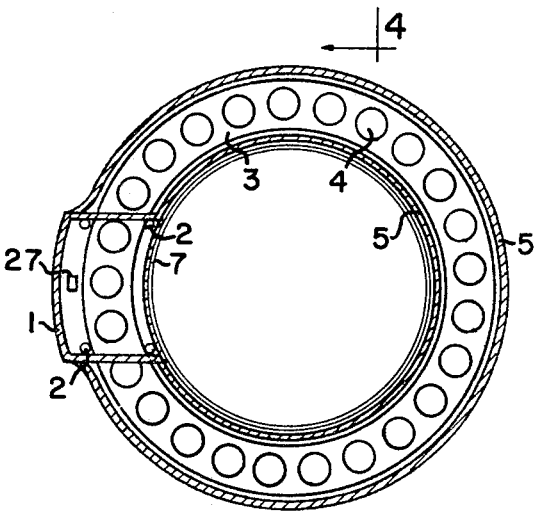
FIG. 4 is a view in the direction of the arrow 4—4 (see FIG. 2)
Figure 5:
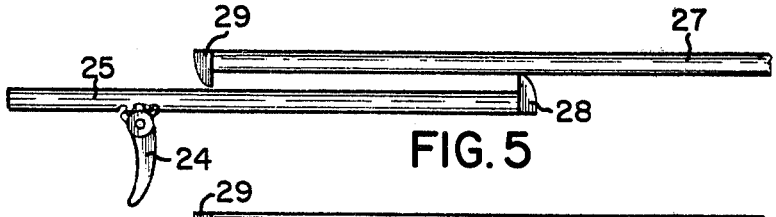
FIG. 5 is a schematic view of a pulling rod of a detent machanism of the inventive arm in a marching position.
Figure 6:
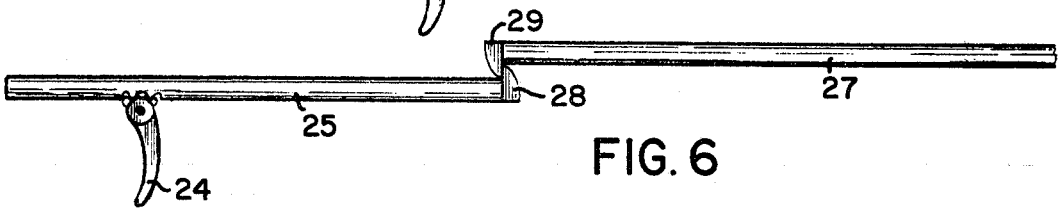
FIG. 6 is a schematic view of the pulling rod of the detent machanism in a firing position.
Figure 7:
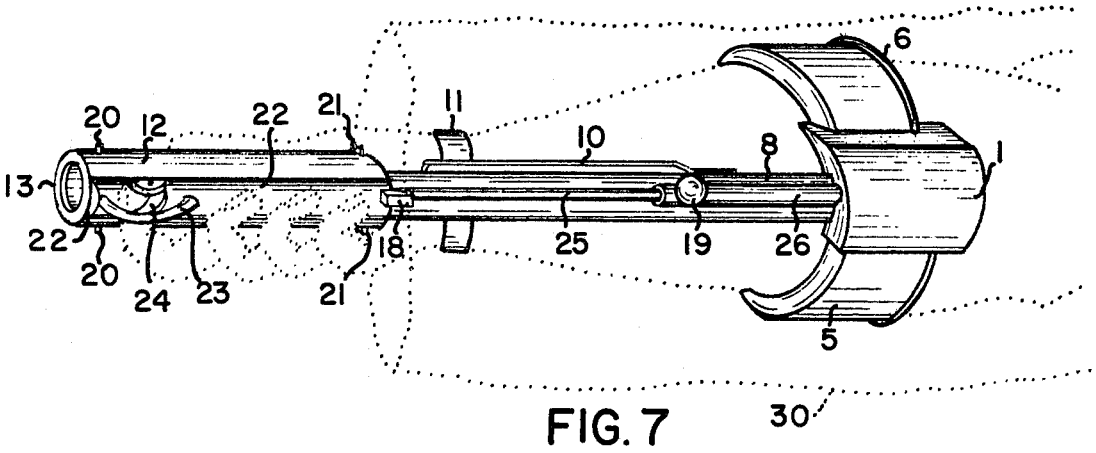
FIG. 7 is an arrangement of the firearm on the arm (in the sleeve) in a firing position.
Figure 8:
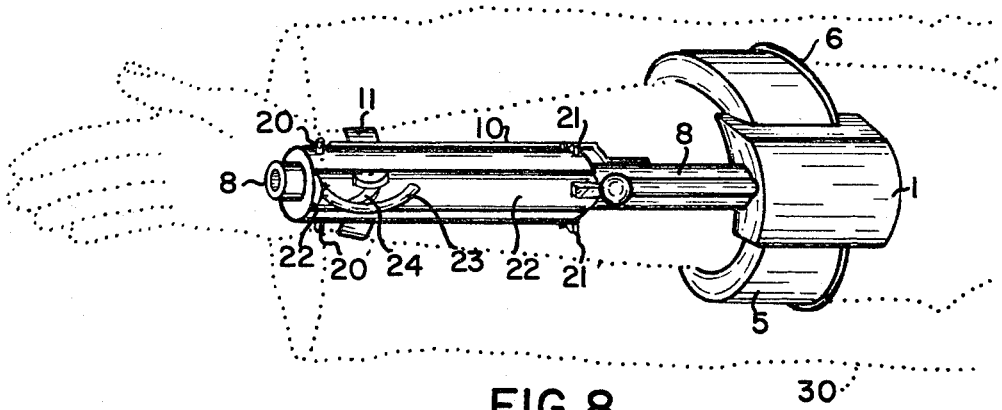
FIG. 8 is an arrangement of the firearm on the arm (in the sleeve) in a marching position.

A firearm such as a pistol is composed of a magazine 1 through which a ring 3 extends on rollers 2, the ring having at its circumference holes 4 for cartridges. A case 5 attached to the outer part of the magazine, the case 5 having a cover 6 for reloading of the used cartridges. On the inner circumference of the case 5 an insulating gasket 7 is attached. A barrel 8 extends from the magazine, and a handle 10 with a small belt 11 and an insulating gasket 11' is mounted as a cantilever on the barrel. A bush 12 is fitted outside of the barrel 8, the bush being adapted to move over annular projections 13 and 14 along its axis with the aid of force of expanded spring 15, having fixing points 16 and 17. The bush 12 is arrested with the aid of a catch 18 in a firing position and a marching position, and it is released by a button 19. The bush 12 has front sights 20 and 20', for the use of, and respectively, rear sights 21 and 21' for use by either hand. The bush 12 has a thickening 22 outside of which a limiting curve 23 and a detent dog 24 are attached, the detent dog being in engagement with a rod 25 located inside of the thickening 22. The bush 12 can move lengthwise of the thickening 26 on the barrel 8 in which also a rod 27 is provided, the rod 27 being able to engage, because of teeth 28 and 29, (in a firing position of the firearm) and transmit pulling force from the detent dog 24 to a striking mechanism and a mechanism of displacement of the ring 3 to the next position. firearm can be put directly onto the arm, onto the sleeve of underclothes so as to cover the same by outer clothes' sleeve.

OPERATION OF THE ARRANGEMENT

In order to prepare the pistol for operation, it is necessary that the bush 12 be clamped by the button 19 with the aid of the catch 18. Then, the cover 6 is opened and necessary number of cartridges are inserted into the holes 4 of the ring 3. The cover is closed and the arm is put through the opening in the case 5 to the forearm so that the small belt 11 mounted on the cantilever handle 10 can be clamped about the arm. The pistol can be covered by the sleeve of clothes, and in such position it is worn in a marching position.

In order to transfer the firearm into a firing position it is sufficient to press the firearm to the side so that the button 19 releases the bush 12, and under the action of the expanded spring 15, over the annular projections 13 and 14 the bush 12 shifts forwardly and is fixed in such a position by the catch 18, at this point the tooth 28 of the rod 25 engages with the tooth 29 of the rod 27.

When it is desired to use the sight, the arm is lifted to the level of eyes and firing is performed in a regular manner. It is also possible to utilize the arm for firing "from the hand". In both cases after pressing of the cock 24, force is transmitted through the rod 25 and 27 to the striker and to the ring 3 which moves to the next position.

The drawing and description do not disclose the operation and construction of the striker, the ring 3 and associated structural elements. These parts are known per se in the art, they are not germane to the present invention, and their operation and construction are conventional.

I claim:

1. A firearm, particularly a pistol and the like, comprising means for loading cartridges, bullets and the like and including a ring element arranged to surround and to be retained on the forearm of the user;

barrel means arranged to extend over the forearm of the user;

means for displacing the cartridges, bullets and the like to a next firing position;

striking means for striking the displaced cartridge, bullet and the like in the firing position;

means for actuating said displacing and striking means, said actuating means including a bush provided with a trigger and at least two sights and movable between a first position in which it is located in the region of the forearm of the user so as to be concealed under a sleeve of the latter, and a second position in which it is displaced to the hand of the user so that the user can act upon said trigger and use said sights, whereby for firing, only said bush with said trigger and said sights are displaced whereas all other means of the firearm remain inside the user's sleeve; and means for moving said bush from said first position to said second position by abutting the firearm against an object such as the user's body.

2. A firearm as defined in claim 1, wherein said moving means includes a spring operatively urging said bush from said first position to said second position, and a holding member which normally holds said spring and prevents the latter from urging, and which can be pressed by abutting of the firearm against the user's body so that said holding member releases said spring for urging said bush by the latter.

3. A firearm as defined in claim 1; and further comprising means for attaching said barrel means in the region of the user's hand, so that the firearm is supported both in the region of the user's forearm by said ring element and in the region of the user's hand by said attaching means.

* * * * *